United States Patent [19]

Obrecht et al.

[11] Patent Number: 4,637,480

[45] Date of Patent: Jan. 20, 1987

[54] AZIMUTH MEASURING METHOD FOR NON-VERTICAL DRILLING

[75] Inventors: Georges Obrecht, Seyssins; Claude Dreuilhe, Saint Ismier, both of France

[73] Assignee: Alsthom, France

[21] Appl. No.: 773,728

[22] Filed: Sep. 9, 1985

[30] Foreign Application Priority Data

Sep. 7, 1984 [FR] France ..... 84 13764

[51] Int. Cl.[4] ..... E21B 7/06

[52] U.S. Cl. ..... 175/45; 175/61; 324/346

[58] Field of Search ..... 175/45, 61; 324/221, 324/346; 33/313

[56] References Cited

U.S. PATENT DOCUMENTS

| | | | |
|---|---|---|---|
| 2,656,505 | 10/1953 | Hewitt, Jr. | 324/346 |
| 3,657,637 | 4/1972 | Claret | 324/346 |
| 3,731,752 | 5/1973 | Schad | 175/45 |
| 4,443,762 | 4/1984 | Kuckes | 324/346 |

FOREIGN PATENT DOCUMENTS

| | | | |
|---|---|---|---|
| 1904308 | 6/1970 | Fed. Rep. of Germany | 324/346 |
| 2068829 | 3/1971 | France . | |

OTHER PUBLICATIONS

"Magnetostatic Methods for Estimating Distance and Direction from a Relief Well to a Cased Wellbore", Jun. 1972.

*Primary Examiner*—Stephen J. Novosad
*Assistant Examiner*—William P. Neuder
*Attorney, Agent, or Firm*—Sughrue, Mion, Zinn, Macpeak, and Seas

[57] ABSTRACT

In a method of measuring azimuth for non-vertical drilling, during rotation of the drill pipe string two components of the magnetic field are measured continuously within a cylindrical section of the drill pipe string. This section is fabricated from the ferromagnetic steel usually employed for fabricating the drill pipes. The two components are measured by a magnetometer and lie along two axes perpendicular to the axis of the section and rotating with it. At the moment when the component of the acceleration due to gravity is maximum along one of these two axes, an accelerometer device commands the calculation and recording of the ratio of the two measured components of the magnetic field. On the basis of the value thus recorded, the measured inclination of the drill pipe string and the local inclination of the magnetic field, the azimuth of the drill pipe string relative to magnetic north is calculated. The method may be used for the continuous determination of the position of a drilling tool during the progress of drilling along a curve.

10 Claims, 2 Drawing Figures

AZIMUTH MEASURING METHOD FOR NON-VERTICAL DRILLING

BACKGROUND OF THE INVENTION

1. Field of the Invention

The present invention applies in particular to measuring the azimuth of the deep part of a drill-hole when the drilling has been deliberately or involuntarily done on a curve. The objective of this measurement is, in particular, to discover the position of the drilling tool and the direction in which it is advancing.

2. Description of the Prior Art

The trajectory of a drill-hole is geometrically determined by two parameters which are in principle defined at each point on the curved axis of the hole, which change along the length of the hole and integration of which over this length of the entry of the hole up to a point on the axis of the hole gives the coordinates of this point. The first of these parameters is the inclination of the axis at the point in question relative to the vertical. The second is defined only if the inclination is not null. It is the azimuth of this axis, that is to say the orientation of the vertical plane through the axis of this section relative to a horizontal reference direction which is in general either magnetic north or geographic north. Measuring it would seem to be more difficult than measuring the inclination.

Methods for measuring the azimuth relative to the geographical north utilize gyroscopic reference devices which have the disadvantage of being extremely sensitive to vibration such as occurs during drilling, as a result of which they must be installed after drilling is stopped and recovered before drilling is resumed.

It is for this reason that the present invention concerns a method of measuring the azimuth relative to the magnetic north, as known methods of this kind enable the measuring devices to be left in place while drilling proceeds. However, the magnetic sensors of these devices are responsive not only to the local terrestrial magnetic field, which they have to use as a reference, but also to stray fields such as those created by nearby ferromagnetic bodies. These devices must be accommodated in the lower part of the drill pipe string. The drill pipe string connects the drilling tool or motor to the surface and is formed by a series of tubes which are generally called "pipes". These pipes, the individual length of which is normally of the order of nine meters, are fabricated from a steel selected for its mechanical properties and price. This steel is ferromagnetic and creates stray magnetic fields.

To be more precise, failing any special precautions, the magnetic field in the vicinity of the lower end of the string of drilling pipes may be defined as the sum of three fields:

the local terrestrial magnetic field due to terrestrial magnetism and the influence of the terrain, a stray magnetic field induced by the local terrestrial magnetic field in the drilling pipes, featuring a symmetry of revolution about the axis of these pipes, and a possible further stray magnetic field associated with the pipes and possibly corresponding to a fixed magnetic assymetry of the drill pipe string or to the presence of a magnetized particle intended, for example, to define the angular position of the plane in which the deviation motor tends to curve the drill-hole. This angular position is known as the "tool face".

Known magnetic azimuth measuring methods eliminate the disturbing influence of such stray fields by replacing two or three of the drill collars (terminal drilling pipes) of the usual, that is ferromagnetic, type with special non-magnetic pipes (monel collars) in one of which the magnetic sensors are accommodated. The sensors are thus removed from sources of stray magnetic fields. However, given the mechanical forces that the drilling pipes have to transmit, the cost of these special pipes is high.

Also, certain known methods involve measuring three components of the magnetic field along three axes orthogonal to one another in pairs and entail temporary immobilization, that is to say temporary halting of rotation of the drill pipe string. As such rotation is generally essential to advancing the drilling, this entails a halt in such advance.

Another known method dispenses with a triple measurement along three fixed axes. It will now be described in outline by virtue of the fact that certain operations may be seen, generally speaking, as common to this known method and to the present invention. These common operations are:

producing a gravitational phase reference signal using a member responsive to gravity and a rotating system disposed in a tubular section of the drill pipe string constituting a measuring section and having an axis locally coincident with the drill-hole axis, this signal being synchronized to the angular position of said system relative to the vertical plane through said axis, producing by means of a member fastened to said rotating system and responsive to the ambient magnetic field in said section a magnetometric signal synchronized to the angular position of said system relative to said magnetic field, said section consisting of a non-magnetic material so that said ambient magnetic field is not excessively different to the local terrestrial magnetic field, measuring the phase of said magnetometric signal relative to said gravitational phase reference signal, and using the result of this measurement to determine the azimuth of the measuring section axis relative to magnetic north.

This known method is described in French Pat. No. 2 068 829 (SAGEM).

To be more precise, this method entails stopping the rotation of the drill pipe string and the advance of drilling prior to the measurement operations. A complex rotating system is rotated about two axes by a motor. A pendulum device is provided with a weight which causes one of these rotation axes to assume a vertical position and which in this instance constitutes said member responsive to gravity. A member which forms part of the rotating system is responsive to the local magnetic field. It has a sensitivity axis and outputs an electrical pulse when the component of this magnetic field along this axis passes through a maximum value during rotation. This pulse constitutes a magnetometric signal as previously mentioned. A rotating member fastened to this member cooperates with a non-rotating member fastened to the weight in order to produce another electrical pulse which constitutes a gravitational phase reference signal as previously mentioned.

Apart from the fact of halting the progress of drilling, this known method has the disadvantages of employing a mechnically complex rotating system and necessitating the installation of non-magnetic drilling pipes.

An objective of the present invention is to enable the azimuth of a drill-hole inclined to the vertical to be measured relative to magnetic north accurately and continuously while drilling advances, without using costly non-magnetic drilling tubes or pipes or any complex special mechanical systems.

Another object of the present invention is to enable the position of a drilling tool to be known accurately, continuously and inexpensively during the progress of the drilling.

SUMMARY OF THE INVENTION

The present invention consists in an azimuth measuring method for non-vertical drilling using a tool disposed at the lower end of a drill pipe string consisting of a succession of drill pipes and which transmits force and rotates during drilling, comprising the operations of:

producing a gravitational phase reference signal using a member responsive to gravity and a rotating system disposed in a tubular section of the drill pipe string constituting a measuring section and having an axis locally coincident with the drill-hole axis, this signal being synchronized to the angular position of said system relative to the vertical plane through said axis, producing by means of a member fastened to said rotating system and responsive to the ambient magnetic field in said section a magnetometric signal synchronized to the angular position of said system relative to said magnetic field, said section consisting of a non-magnetic material so that said ambient magnetic field is not excessively different to the local terrestrial magnetic field, measuring the phase of said magnetometric signal relative to said gravitational phase reference signal to produce a phase indication, and using the result of this measurement to determine the azimuth of the measuring section axis relative to magnetic north, in which method:

said gravitational phase reference signal and said magnetometric signal are produced while said drill pipe string is rotating, so as not to interrupt drilling, rotation of said drill pipe string rotating said measuring section which rotates about its axis and constitutes said rotating system, said drill pipes are of ferromagnetic steel on either side of said measuring section so as to combine low cost with high mechanical strength and to be magnetized by the local terrestrial magnetic field to create an induced magnetic field in said measuring section, which may be asymmetrical magnetically relative to its axis and may comprise permanently magnetized members so that the ambient magnetic field in said measuring section consists of the sum of the local terrestrial magnetic field, the stray magnetic field, if any, from said members and said magnetic field induced by said drill pipes near said section, said induced magnetic field being parallel to the axis of said section by virtue of the tubular shape of said drill pipe string, and producing said magnetometric signal entails measuring at least one component of said ambient magnetic field along a magnetometric axis associated with said section and perpendicular to its axis to determine variations in said component in order to provide at least one magnetometric signal independent of said induced and stray magnetic fields and which alternates at the period of rotation of said drill pipe string, said method further comprising the operations of:

measuring the angle of inclination of the axis of said measuring section relative to the vertical to provide an inclination indication representative of this angle, and combining the phase indication and the drill pipe string inclination indication with a predefined magnetic field inclination indication representative of the inclination of the terrestrial magnetic field at the drilling site to produce an azimuth indication representative of the angle between the vertical plane through the drill pipe string axis and the vertical plane of the terrestrial magnetic field.

It is to be understood that the word "signal" is used here in a general sense: A signal may consist not only of an electrical potential or current in a conductor, or a pressure in a pipe, etc, but also of the frequency of an electrical, hydraulic or mechanical oscillatory system, the difference between the positions of two mechanical parts, etc. It is a matter of any physical magnitude varying in time according to the variations in the magnitude represented and capable of being used as an indication of this latter magnitude. However, in practice, signals of the more usual, that is to say electrical, type carried by electrical conductors seem the easiest to use at the present time.

The use of a rotating system consisting simply of a section of the drill pipe string in order to produce the magnetometric and phase reference signals avoids any recourse to a special mechanical rotation device, inevitably complex and fragile to some extent, since the drill pipe string must in any case be driven in rotation for drilling to advance. However, this solution has the evident disadvantage that the rotation speed of a rotating system of this kind is imposed and cannot be chosen so as to provide good conditions for measuring the azimuth. As is known, the rotation speed of the drill pipe is subject to frequent variation associated with the advance of drilling and obviously likely to disturb the measurement of relative angular phase during the rotation. The inventors of the present invention have realized that this disadvantage can be overcome by provisions sufficiently simple as not to increase significantly the cost of the azimuth measurement. These provisions are decribed hereinafter.

The inclination of the axis of the measuring section relative to the vertical may be measured in various ways known or not to the man skilled in the art. One of these methods will be described hereinafter.

The drill pipe string inclination phase information and magnetic field inclination information may be combined at the surface from the phase and inclination measurements. The results of these measurements may be transmitted up from the bottom of the drill-hole, using the known MUD-PULSE process, for example. They may also be combined at the bottom of the drill hole by means of an appropriately programmed computer disposed in the measuring section, a register of which holds the field inclination information written into it at the surface before drilling commences. The combination is done by means of trigonometric calculations which lie within the competence of those skilled in the art. The result of this kind of calculation will be set out hereinafter.

The length of the non-magnetic part of the drill pipe string, that is to say of the measuring section proper and any connection areas for fitting it, may be the same as that of a standard drill pipe, of the order of 9 m, whereas in the prior art methods this was several dozen meters. However, this length may with advantage and in accordance with the invention be reduced, to a value of the order of 2 m, for example, for even easier mounting. It may be even further reduced, but should not be made much smaller than the diameter of the drill pipes. If this were the case, the direct influence of the local terrestrial magnetic field on the magnetometers in the measuring section would become too small relative to that of the field induced by the nearest ferromagnetic parts of the drill pipe string.

In the context of the invention, the following provisions may be advantageously implemented:

Said measurement of at least one component of the magnetic field consists in measuring first and second components Hx and Hy along first and second magnetometric axes Ox and Oy perpendicular to the axis Oz of the measuring section, and preferably perpendicular to one another. This measurement entails the determination of an average value $(\overline{Hx}=Hxm+HxM)/2$ and $\overline{Hy}=(Hym+HyM)/2$ of each component, the symbols HxM and Hxm respectively designating the maximum and minimum values of the component Hx, analogous symbols being used for the component Hy. First and second alternating current magnetometric signals are respectively constituted by the difference $Hx-\overline{H}x$ between the first component and its average value and by the difference $Hy-\overline{H}y$ between the second component and its average value. Said gravitational phase reference signal is produced in such a way as to mark directly a specific time. (A signal of this kind may consist of a short pulse, for example, or a rectangular pulse, the marked time being that of its rising or falling edge, or by a combination of two signals marking the time at which they pass through equal values, etc. This is in contradistinction to a sinusoidal signal, for example, which would contain an unknown direct current component and to which sychronization would certainly be possible in order to define a specific time using an auxiliary circuit, but which would not mark this time directly).

Said phase measurement is then done by measuring the ratio $(Hy_o-\overline{H}y)/(Hx_o-\overline{H}y)$ of the instantaneous value of the second of said alternating current magnetometric signals to that of the first at time $t_o$ marked by the gravitational phase reference signal and said phase indication is represented by an angle $a_1$ defined by this ratio of the second to the first magnetometric signal. This angle is that of which the tangent tan $a_1$ is equal to this ratio if the two magnetometric axes are mutually perpendicular. The angle defined by this ratio is reduced by the predetermined angle of advance, if any, of the first magnetometric axis around the axis of the measuring section relative to a plane which is associated with this section and which passes through its axis, and by the vertical at the time marked by the phase reference signal. The phase indication is not then affected by any variation in the rotation speed of the drill pipe string.

The angle $a_1$ is defined to the nearest 180° by the equation:

$$\tan a_1=(\overline{H}y_o-Hy)/(Hx_o-\overline{H}x)$$

Although this method of calculating the angle $a_1$ seems preferable with regard to the objective of avoiding variations in the rotation speed of the drill pipe string giving rise to measuring errors, it is to be understood that what is essential with regard to the present invention is that the angle $a_1$ be defined by measuring a ratio of magnetic values and not by measuring a time or even a time ratio.

It would be possible, given the availability of further imprecise information on the angle $a_1$, to measure it precisely by means of its cosine by measuring only the component Hx and calculating the expression:

$$2(Hx_o-\overline{H}x)/(HxM-Hxm)$$

Also, said angle determined in advance, if any, is preferably null, in other words the gravitational phase reference signal preferably marks the time at which the first magnetometric axis passes through the vertical plane through the axis of the measuring section.

Producing a gravitational phase reference signal preferably entails measuring the total acceleration at a point inside the measuring section and fixed relative thereto, along at least one accelerometric axis also fixed relative thereto and inclined to its axis, so that this total acceleration is the sum of the acceleration due to gravity and the centrifugal acceleration, if any, due to the rotation of the drill pipe string and so that the measured acceleration comprises an accelerometric component alternating at the period of this rotation. The gravitational phase reference signal is then synchronized to this alternating accelerometric component, said phase indication being representative of an angle of advance of the alternating magnetometric signal relative to this reference signal. This angle of advance must, of course, be reduced by the angle of advance, if any, of the magnetometric axis relative to the accelerometric axis about the axis of the measuring section, and reduced by the angle of retardation, if any, of the gravitational phase reference signal relative to a time at which said alternating accelerometric component reaches an extreme value.

The gravitational phase reference signal preferably marks the time at which the measured component of the total acceleration passes through an extreme, for example a maximum, value so as to render null said angle of retardation, if any, of the gravitational phase reference signal.

Said accelerometric axis is preferably perpendicular to the axis of the measuring section. In this case, after measuring variations of a component of the acceleration along this axis, it is possible to calculate the ratio of an accelerometric value defined hereinafter to the predetermined local gravitational acceleration. This accelerometric value is half the amplitude of the variations in a component of the acceleration known from this measurement. As a result, this ratio is equal to the sine of the angle of inclination of the axis of the measuring section to the vertical and the measurement completed by this calculation constitutes said measurement of the inclination of the axis of the measuring section.

Measuring the variations in at least one component of the total acceleration preferably entails measuring first, second and third components of this acceleration at three points equidistant from the axis of the drill pipe string along first, second and third accelerometric axes perpendicular to the axis of the measuring section, starting from this axis and disposed at angles of 120° relative to one another. There are formed in this way first, second and third accelerometric signals respectively representing these components. A total accelerometric signal is then calculated equal to the first accelerometric signal reduced by half the sum of the other two, so that this signal is independent of the centrifugal acceleration and is a periodic signal alternating at the period of rotation of the drill pipe string. One third of the amplitude of this total signal constitutes said accelerometric value used to produce said drill pipe string inclination indication. The gravitational phase reference signal is then preferably produced from the second and third accelerometric signals and marks one of the four times in each rotation period where the difference between the absolute values of these signals cancels out.

It is to be understood that a number of acceleration components other than three could be measured in order to produce the gravitational phase reference signal.

In the case where this number is equal to three, it would be possible to use the results of these measurements in a way different to that described above. If they are used in this way, the phase reference signal marks, for example, on each revolution of the measuring section, the time $t_o$ at which, simultaneously, the difference $F_2-F_3$ cancels out (which happens twice per revolution) and the first accelerometric signal $F_1$ is positive (and therefore maximal). Said angle of retardation, if any, of the phase reference signal is then null.

As for the angle of advance, if any, of the magnetometric axis used to produce said phase indication, this is an angle of advance relative to the first accelerometric axis and is null if this axis is parallel to and in the same direction as the magnetometric axis.

In the case where the measurement of a component of the magnetic field is done using a magnetometer featuring unwanted sensitivity to components of the magnetic field perpendicular to said magnetometric axis, there are disposed one on each side of the measuring point two compensation coils energized to create a compensation magnetic field which is substantially homogeneous and parallel to the axis of the measuring section, the component of the resulting magnetic field along the axis is measured at this point, and the electrical current through the coils is controlled in accordance with the result of this measurement so as to create a compensation field which is proportional to and very much higher than this component, and in the opposite direction, so as to effectively reduce this component to a substantially null value.

Another possibility is simply to reduce the axial magnetic field to a sufficiently low value for correct operation of the magnetometers along the $O_x$ and $O_y$ axes to be obtained by generating a predetermined fixed magnetic field, for example.

Another object of the present invention is a method for continuously measuring the position of a drilling tool operative at the lower end of a rotating flexible drill pipe string. In this method:

the inclination of the axis of a measuring section forming part of the drill pipe string and situated in the vicinity of the drilling tool is measured continuously as drilling progresses, the azimuth of this axis is measured continuously using the above-defined azimuth measuring method with the assistance of an automatic computer, and the position of the tool is continuously calculated in an automatic computer using past and present results of the aforementioned measurements.

The position of the tool is generally calculated by digital integration of the three components of displacement along three axes perpendicular to one another in pairs and having their origin at the top of the drill-hole, one being vertical and another directed towards magnetic north.

The manner in which the invention may be put into practice will now be described by way of non-limiting example with reference to the accompanying drawings.

DESCRIPTION OF THE PREFERRED EMBODIMENT

Figure 1:
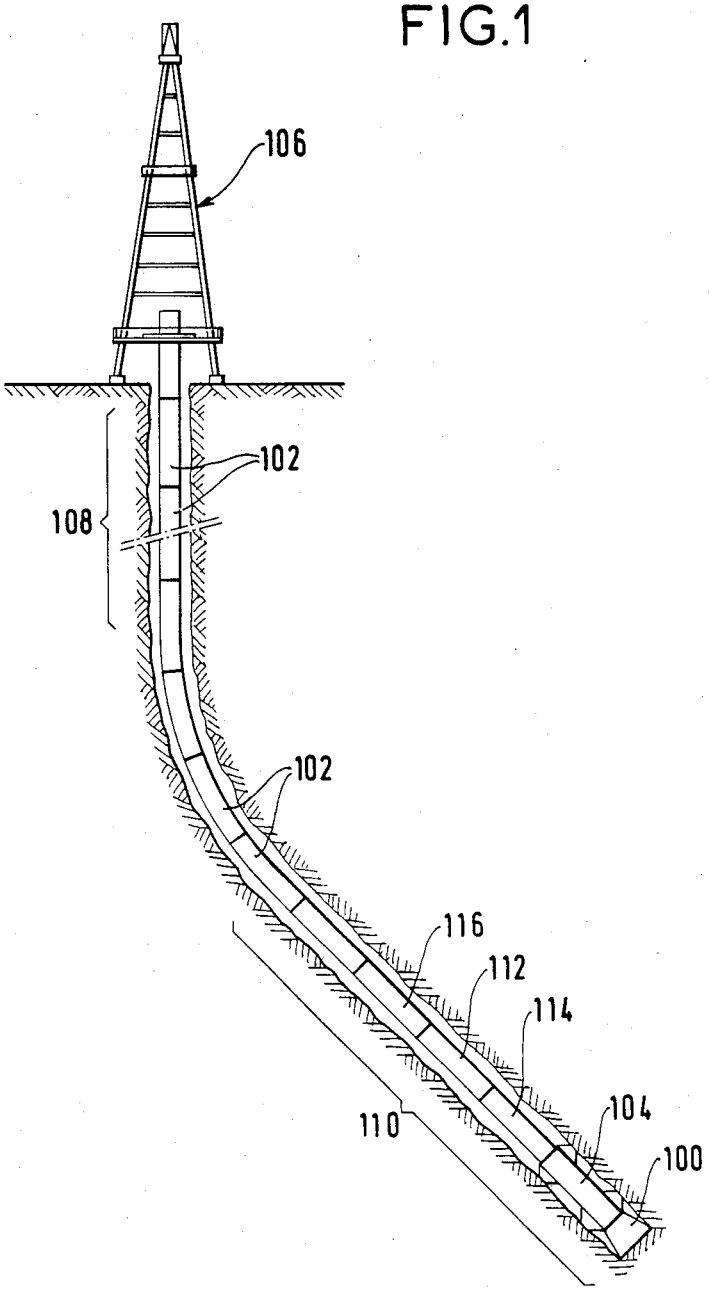
FIG. 1 is a view in cross-section of a well being drilled to which the method in accordance with the invention is applied.

Referring to FIG. 1, a well is being drilled by a tool 100 rotating at high speed. The tool is disposed at the bottom end of a drill pipe string. This conventionally consists of a series of tubes or "pipes" 102 fabricated from steel, screwed together and driven in rotation at low speed from an installation 106 on the surface of the ground. These pipes transmit high torsion and axial thrust forces. Mud is injected under pressure into an axial conduit in the drill pipe string. It supplies the motive power to an underground motor 104 which drives the tool 100. It rises again to the surface in the part of the well outside the drill pipe string. It also constitutes a continuous medium transmitting pressure pulses produced by a sending device (not shown) situated in the vicinity of the tool 100. These pulses represent the results of measurements carried out at the bottom, transmitted by the known MUD-PULSE process. It also fulfils the other conventional functions of drilling mud.

The upper part 108 of the drill-hole is vertical. The lower part 110 is inclined by known means not related to the present invention, this being permitted by a certain degree of elastic flexibility of the pipes. This lower part is rectilinear, for example, and it is important to know its inclination relative to the vertical and its azimuth, for the reasons previously indicated. For this purpose measuring devices responsive to gravity and to magnetic fields are disposed in the vicinity of the tool 100. These devices are placed within a drilling pipe which constitutes one section of the length of the drill pipe string and may be referred to as the "measuring section". In accordance with the present invention, only the pipe constituting this section is fabricated from a non-magnetic steel. In accordance with the present invention, this pipe 112 may be separated from the motor 104 by a spacing pipe 114. Because of the cylindrical shape of the pipes the induced magnetization of the rods creates within the measuring section 112 an induced stray magnetic field parallel to the axis of the section, provided that the combination of the measuring section and the two pipes 114 and 116 on either side of it is not deformed by the curvature of the drill-hole.

Figure 2:
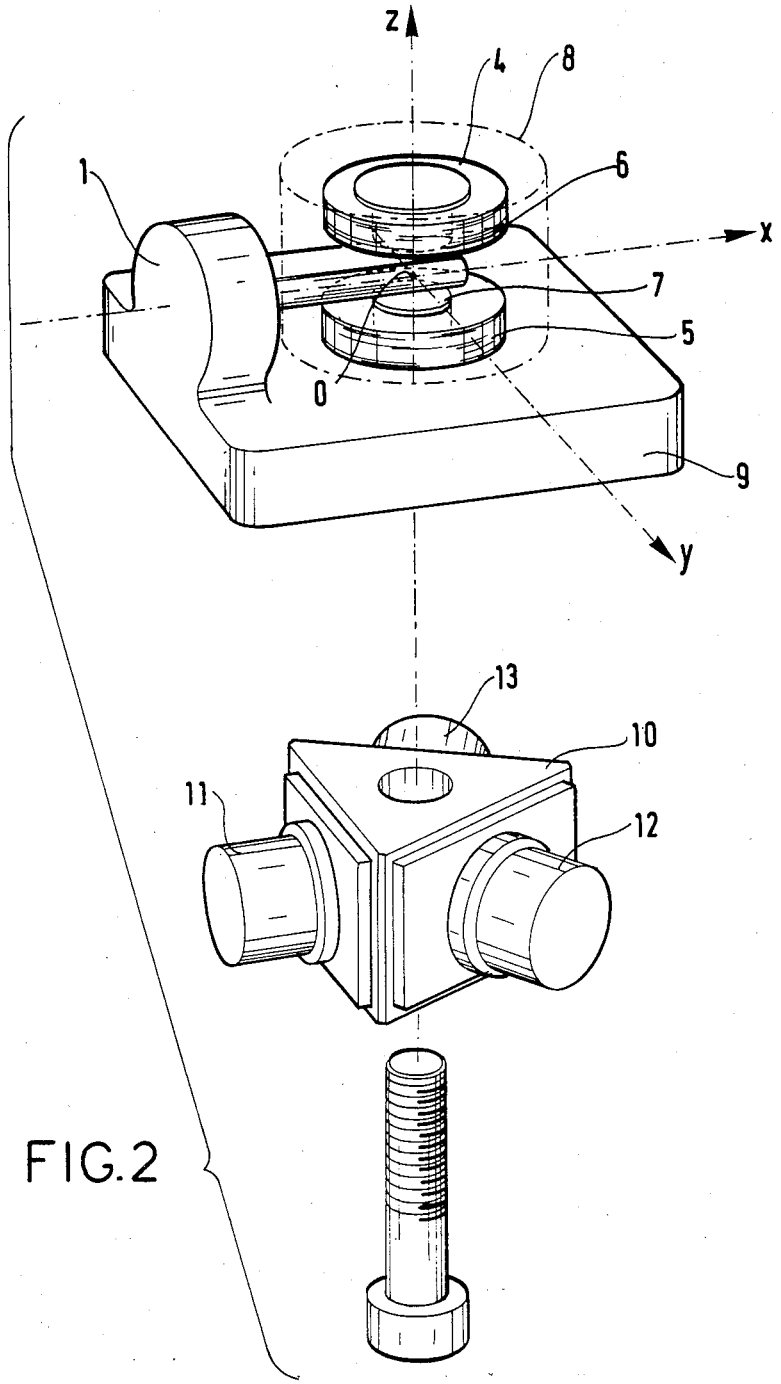
FIG. 2 is an exploded view in perspective of a magnetometer and accelerometer assembly adapted to be disposed within a drill pipe section of FIG. 1 for the purposes of implementing the azimuth measuring method in accordance with the invention.

Inside the axial passage in the measuring section 112 are fixed a measuring assembly shown in FIG. 2, a computer (not shown) and a sending unit (also not shown) adapted to transmit to the surface of the ground, using the mud-pulse process, for example, signals produced by the computer and representing the azimuth and inclination of the axis of the measuring section, and possibly the position of the tool as calculated by integration.

The measuring assembly wil now be described. It comprises a magnetometer 1 with three measuring heads capable of measuring at substantially the same point O the components of magnetic field along three axes Ox, Oy and Oz perpendicular to one another in pairs. The axis Oz is that of the measuring section 112, which rotates about it, and the measuring point O is situated on this axis.

Two compensation coils 4 and 5 coaxial with the axis Oz are disposed one on either side of the measuring point O in order substantially to eliminate the component Hz of the field along the Oz axis. In the absence of these coils, this component would be much greater than those Hx and Hy along the axes Ox and Oy and would disturb the measurement of the latter. The device energizing these coils (not shown) is controled, as previously mentioned, according to the result of measuring Hz, so as to constitute a control loop.

Coaxial with these coils are two soft iron or ferrite cores 6 and 7 of very large cross-section, delimiting between their facing ends a cylindrical space in which the magnetic field along the Oz axis is at all points equal, parallel to the Oz axis and, by virtue of the control loop, of very low or null value.

The other two measuring heads are very near the Oz axis and in any event definitely within the circular area between the coils 6 and 7 where the field in the Oz direction is virtually null.

The assembly of the coils, cores and measuring heads is immobilized in a non-magnetic and temperature-resistant resin 8 and then oriented on and fixed to a non-magnetic plate 9.

To the other side of this plate is fixed a support 10 to which are fixed three accelerometers 11, 12 and 13. The three accelerometric measuring axes are coplanar and perpendicular to the axis Oz. One of the accelerometers (11) is parallel to the aforementioned axis Ox, the other two (12 and 13) being at 120° to the accelerometer 11.

A commercially available 3-axis accelerometer unit may be employed, provided of course that it is correctly oriented and locked in position and that the calculation programs are modified accordingly.

In practice, the measurement points of the three accelerometers may be regarded as coincident with the point O, the axis Ox then constituting the first magnetometric axis and also the first accelerometric axis previously mentioned.

The azimuth $a_o$ may be calculated in various ways known to those skilled in the art from the phase angle $a_1$, the angle of inclination i of the Oz axis relative to the vertical and the angle of inclination b of the terrestrial field downwards from a horizontal plane. Specifically, it is possible to calculate:

$$\cos a_1 = 2(Hx_o - \overline{Hx})/(HxM - Hxm)$$

and to use the following formula for tan $a_o$:

$$\frac{\tan a_1 \cos i\,(1 - \tan^2 b \tan^2 i)}{1 + j \tan i \tan b \sqrt{[(1 + \tan^2 a_1 \cos^2 i\,(1 - \tan^2 b \tan^2 i)]}}$$

in which j has the value +1 or −1 according to whether the product tan b cos $a_1$ is positive or negative. The value of $a_o$ is defined only to the nearest 180° by this formula, but it is known that $a_o$ is within the range −90° to +90° if cos $a_1$ is positive and outside this range if cos $a_1$ is negative.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Azimuth measuring method for non-vertical drilling using a tool disposed at the lower end of a drill pipe string consisting of a succession of drill pipes and which transmits force and rotates during drilling, comprising the operations of:

producing a gravitational phase reference signal using a member responsive to gravity and a rotating system disposed in a tubular section of the drill pipe string constituting a measuring section and having an axis locally coincident with the drill-hole, this signal being synchronized to the angular position of said system relative to the vertical plane through said axis, producing by means of a member fastened to said rotating system and responsive to the ambient magnetic field in said section a magnetometric signal synchronized to the angular position of said system relative to said ambient magnetic field, said section consisting of a non-magnetic material so that said ambient magnetic field is not excessively different to the local terrestrial magnetic field, measuring the phase of said magnetometric signal relative to said gravitational phase reference signal to produce a phase indication, and using the result of this measurement to determine the azimuth of the measuring section axis relative to magnetic north, in which method:

said gravitational phase reference signal and said magnetometric signal are produced while said drill pipe string is rotating, so as not to interrupt drilling, rotation of said drill pipe string rotating said measuring section which rotates about its axis and constitutes said rotating system, said drill pipes are of ferromagnetic steel on either side of said measuring section so as to combine low cost with high mechanical strength and to be magnetized by the local terrestrial magnetic field and create in said measuring section a parasitic induced magnetic field, means such as the tubular shape of the ferromagnetic steel drill pipes for cancelling any component of said parasitic induced magnetic field perpendicular to the axis of said measuring section, and wherein said operation of producing said magnetometric signal entails measuring at least one component of said ambient magnetic field along a magnetometric axis associated with said section and perpendicular to its axis to determine variations in said component in order to provide at least one magnetometric signal which is independent of said induced magnetic field and which is independent of the field of any permanently magnetic parts in said measuring section and which alternates at the period of rotation of said drill pipe string, said method further comprising the steps of:

measuring the angle of inclination of the axis of said measuring section relative to the vertical to provide an inclination indication representative of this angle, and combining said phase indication and said inclination indication with a predefined magnetic field inclination indication representative of the inclination of the terrestrial magnetic field at the drilling site to produce an azimuth indication representative of the angle between the vertical plane through the axis of said measuring section and the vertical plane of the terrestrial magnetic field.

2. Method according to claim 1, wherein the phase of said magnetometric signal is measured by measuring the ratio of two magnitudes each equivalent to a magnetic field so that the result of this measurement is not affected by any variation in the rotation speed of the drill pipe string.

3. Method according to claim 2, wherein said step of producing said magnetometric signal comprises measuring first and second components along first and second magnetometric axes perpendicular to the axis of the measuring section, this measurement entailing the determination of an average value of each of said components, first and second alternating current magnetometric signals being respectively obtained as the difference between said first component and its average value and the difference between said second component and its average value, said gravitational phase reference signal marks a specific time, and said phase measurement entails measuring the ration of the instantaneous value of said second alternating current magnetometric signal to that of the first at said time marked by said gravitational phase reference signal, said phase indication being represented by an angle defined by this ratio of said second to said first magnetometric signal, said angle being that of which the tangent is equal to said ratio if the two magnetometric axes are perpendicular to one another, said angle defined by said ratio being reduced by the predetermined angle of advance, if any, of said first magnetometric axis around the axis of the measuring section relative to a plane which is fixed relative to this section and which passes through the axis thereof and the vertical at said time marked by said phase reference signal.

4. Method according to claim 1, wherein said operation of producing a gravitational phase reference signal entails measuring the total acceleration at a point inside said measuring section and fixed relative thereto, along at least one accelerometric axis also fixed relative thereto and inclined relative to the axis thereof, so that this total acceleration is the sum of the acceleration due to gravity and the centrifugal acceleration, if any, due to the rotation of the drill pipe string and so that the measured acceleration comprises an accelerometric component alternating at the period of said rotation, said gravitational phase reference signal is synchronized to said alternating accelerometric component, and said phase indication represents an angle of advance of said alternating magnetometric signal relative to said gravitational reference signal, said angle of advance being reduced by the angle of advance, if any, of said magnetometric axis relative to said accelerometric axis about said axis of said measuring section and reduced by the angle of retardation, if any, of the gravitational phase reference signal relative to a time at which said alternating accelerometric component reaches an extreme value.

5. Method according to claim 4, in which said gravitational phase reference signal marks the time at which the measured component of the total acceleration passes through an extreme value, so as to render null said angle of retardation, if any, of said gravitational phase reference signal.

6. Method according to claim 4, wherein said accelerometric axis is perpendicular to the axis of said measuring section and, after measuring said variations in at least one component of the acceleration, the ratio is calculated of one accelerometric value to the predetermined local acceleration due to gravity, said accelerometric value being half the amplitude of the variations of a component of the acceleration known from this measurement, so that said ratio is equal to the sine of the angle of inclination of the axis of the measuring section to the vertical, this measurement completed by this calculation constituting said measurement of the inclination of the axis of the measuring section.

7. Method according to claim 6, wherein said variations in at least one component of the total acceleration are measured by measuring a first, a second and a third component of this acceleration at three points equidistant from the axis of the drill pipe string along a first, a second and a third accelerometric axis perpendicular to the axis of the measuring section, starting from this axis and offset relative to one another at angles of 120°, so as to form a first, a second and a third accelerometric signal respectively representing these components, a total accelerometric signal is calculated equal to the first accelerometric signal reduced by half the sum of the other two, so that this signal is independent of the centrifugal acceleration and alternates with the period of rotation of the drill pipe string, one third the amplitude of this total signal constituting said accelerometric value used to produce said drill pipe string inclination indication, and said gravitational phase reference signal is produced from said second and third accelerometric signals and marks one of the four times in each period of rotation at which the difference between the absolute values of these signals cancels out.

8. Method according to claim 4, characterized in that the point at which said total acceleration is measured is located substantially on the axis of said measuring section so that the centrifugal acceleration at said point is substantially null.

9. Method according to claim 1, wherein, when one component of the magnetic field is measured by means of a magnetometer showing unwanted sensitivity to stray magnetic field components perpendicular to said magnetometric axis, two compensation coils are placed one on either side of the measurement point and electrically energized to create at said point a compensation magnetic field which is substantially homogeneous and parallel to the axis of the measuring section.

10. Method for continuously measuring the position of a drilling tool operating at the lower end of a rotating flexible drill pipe string in which:

the inclination of the axis of a measuring section forming part of the drill pipe string and situated in the vicinity of the tool is measured continuously as drilling advances;

the azimuth of said axis is measured continuously using an automatic computer and an azimuth measuring method for non-vertical drilling using a tool disposed at the lower end of a drill pipe string consisting of a succession of drill pipes and which transmits force and rotates during drilling, comprising the operations of:

producing a gravitational phase reference signal using a member responsive to gravity and a rotating system disposed in a tubular section of the drill pipe string constituting a measuring section and having an axis locally coincident with the drill-hole axis, this signal being synchronized to the angular position of said system relative to the vertical plane through said axis, producing by means of a member fastened to said rotating system and responsive to the ambient magnetic field in said section a magnetometric signal synchronized to the angular position of said system relative to said ambient magnetic field, said section consisting of a non-magnetic material so that said ambient magnetic field is not excessively different to the local terrestrial magnetic field, measuring the phase of said magnetometric signal relative to said gravitational phase reference signal to produce a phase indication, and using the result of this measurement to determine the azimuth of the measuring section axis relative to magnetic north, in which method:

said gravitational phase reference signal and said magnetometric signal are produced while said drill pipe string is rotating, so as not to interrupt drilling, rotation of said drill pipe string rotating said measuring section which rotates about its axis and constitutes said rotating system, said drill pipes are of ferromagnetic steel on either side of said measuring section so as to combine low cost with high mechanical strength and to be magnetized by the local terrestrial magnetic field to create an induced magnetic field in said measuring section, which may be magnetically asymmetrical relative to its axis and may comprise permanently magnetized members so that the ambient magnetic field in said measuring section consists of the sum of the local terrestrial magnetic field, the stray magnetic field, if any, from said members and said magnetic field induced by said drill pipes near said section, said induced magnetic field being parallel to the axis of said section by virtue of the tubular shape of said drill pipes, and producing said magnetometric signal entails measuring at least one component of said ambient magnetic field along a magnetometric axis associated with said section and perpendicular to its axis to determine variations in said component in order to provide at least one magnetometric signal independent of said induced and stray magnetic fields and which alternates at the period of rotation of said drill pipe string, said method further comprising the operations of:

measuring the angle of inclination of the axis of said measuring section relative to the vertical to provide an inclination indication representative of this angle, and combining the phase indication and the drill pipe string inclination indication with a predefined magnetic field inclination indication representative of the inclination of the terrestrial magnetic field at the drilling site to produce an azimuth indication representative of the angle between the vertical plane through the drill pipe string axis and the vertical plane of the terrestrial magnetic field;

and the position of the tool is calculated continuously using an automatic computer and the past and present results of the aforementioned measurements.

* * * * *